US008494435B2

(12) United States Patent
Nakamichi

(10) Patent No.: US 8,494,435 B2
(45) Date of Patent: Jul. 23, 2013

(54) IMAGE FORMING SYSTEM AND IMAGE FORMING DEVICE

(75) Inventor: Motoki Nakamichi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 622 days.

(21) Appl. No.: 12/612,858

(22) Filed: Nov. 5, 2009

(65) Prior Publication Data

US 2010/0119277 A1 May 13, 2010

(30) Foreign Application Priority Data

Nov. 7, 2008 (JP) ..... 2008-286411

(51) Int. Cl.
*B41J 29/38* (2006.01)
*G03G 21/14* (2006.01)

(52) U.S. Cl.
USPC ..... 399/407

(58) Field of Classification Search
USPC ..... 399/407, 76, 77, 408, 410, 83, 88; 412/13
See application file for complete search history.

(56) References Cited

U.S. PATENT DOCUMENTS

2007/0280708 A1 * 12/2007 Kamisuwa et al. ..... 399/37

FOREIGN PATENT DOCUMENTS

| | | | |
|---|---|---|---|
| JP | 2003043868 | * | 2/2003 |
| JP | 2005-195929 | | 7/2005 |
| JP | 2007-90527 | | 4/2007 |
| JP | 2009178855 | * | 8/2009 |
| JP | 2010131801 | * | 6/2010 |

* cited by examiner

*Primary Examiner* — Matthew G Marini
*Assistant Examiner* — Ruben Parco, Jr.
(74) *Attorney, Agent, or Firm* — Finnegan, Henderson, Farabow, Garrett & Dunner, L.L.P.

(57) ABSTRACT

Disclosed is an image forming system including an image forming device to form an image on a paper and a plurality of post processing devices, and the image forming device includes an ejecting place information informing unit, a comparing unit and a stopping permission information informing unit, and the post processing devices include a determination unit, a permission request unit and an actuation determination unit.

7 Claims, 12 Drawing Sheets

IMAGE FORMING SYSTEM AND IMAGE FORMING DEVICE

BACKGROUND OF THE INVENTION

1. Field of the Invention

The present invention relates to an image forming system and an image forming device.

2. Description of Related Art

As an image forming device becomes faster and becomes multi-functional by making full used of digital technologies, there is a desire for the post processing device which processes a paper to which image forming is carried out to become multi-functional. In order to meet such needs, there is an image forming system in which a plurality of post processing devices are connected to one image forming device.

In such image forming system, consumption energy increases as the entire system becomes large. Therefore, power saving is one of problems which needs to be solved.

Moreover, the image forming system becomes inevitably large in order to enrich functions of the system. Therefore, restriction of noise which becomes loud due to enlarging of the system is a problem.

In view of the above problems, there is known an image forming system where when a post processing device which is included in the system determines that the image forming processing is consecutively carried out to more than a predetermined sheets of papers without the papers being conveyed to own device, operation of the own device is made to stop (for example, see JP2005-195929).

Further, there is known an image forming system where the image forming device switches a post processing device to a power saving mode according to the use situation of the post processing device and where power supply is cut off except for the parts which are set as targets to maintain energized condition in advance for the post processing device (for example, see JP2007-90527).

SUMMARY OF THE INVENTION

However, according to the above JP2005-195929 and JP2007-90527, time needed from starting of stopping operation to completion of the operation for each of the post processing devices (that is, time when post processing operation cannot be executed) is not being considered. Therefore, when a request to carry out a post processing again in the own device is requested from the image forming device during the above described time, the processing cannot be carried out and the image forming device will be in a waiting state until the above described time passes. Therefore, there is a problem that productivity of the entire image forming system is dropped down.

According to a first aspect of the present invention, there is provided an image forming system comprising an image forming device to form an image on a paper and a plurality of post processing devices which are serially connected to the image forming device and each of which carries out a predetermined post processing to the paper on which the image is formed by the image forming device and ejects the paper, and the image forming device comprises an ejecting place information informing unit to inform ejecting place information relating to a post processing device which becomes an ejecting place of the paper page by page to each of the post processing devices, a comparing unit to compare a stop time to an estimated ejection time when a request is made by a permission request unit of a post processing device, the stop time being a time needed from when the post processing device starts a stopping operation after ejecting a last paper before a change in the post processing device which is requested until when the stopping operation is completed and the estimated ejection time being an estimated time until the paper is ejected after the post processing device which is the ejecting place is changed to the post processing device in an upstream side and after being changed back again to the post processing device and a stopping permission information informing unit to inform stopping permission information to the post processing device which made the request when the estimated ejection time is longer than the stop time as a result of a comparison by the comparing unit, and the post processing devices comprise a determination unit to determine whether a post processing device which is the ejecting place is to be changed to the post processing device in the upstream side which is connected at the upstream side of an own device or not for each page based on the ejecting place information informed by the ejecting place information informing unit, a permission request unit to request a permission to stop an actuation of the own device to the image forming device when the determination unit determines that the post processing device which is the ejecting place is to be changed to the post processing device in the upstream side from the own device and an actuation determination unit to execute the stopping operation when the stopping permission information is informed by the stopping permission information informing unit and not to execute the stopping operation when the stopping permission information is not informed.

According to a second aspect of the present invention, there is provided an image forming system comprising an image forming device to form an image on a paper and a plurality of post processing devices which are serially connected to the image forming device and each of which carries out a predetermined post processing to the paper on which the image is formed by the image forming device and ejects the paper, and the image forming device comprises an image forming device determination unit to determine whether a post processing device which is an ejecting place is to be changed to a post processing device in an upstream side which is connected at the upstream side of a predetermined post processing device from the predetermined post processing device or not for each page based on ejecting place information relating to the post processing device to which the paper is to be ejected, a comparing unit to compare a stop time to an estimated ejection time when the image forming device determination unit determines that the post processing device which is the ejecting place is to be changed to the post processing device in the upstream side from the predetermined post processing device, the stop time being a time needed from when the predetermined post processing device starts a stopping operation after ejecting a last paper before a change in the predetermined post processing device until the stopping operation is completed and the estimated ejection time being an estimated time until the paper is ejected after the post processing device which is the ejecting place is changed to the post processing device in the upstream side and after being changed back again to the predetermined post processing device and a stopping permission information informing unit to inform stopping permission information to the predetermined post processing device when the estimated ejection time is longer than the stop time as a result of a comparison by the comparing unit, and the predetermined post processing device comprises an actuation determination unit to execute the stopping operation when the stopping permission information is informed by the stopping permission information informing unit and not to execute the stopping operation when the stopping permission information is not informed.

According to a third aspect of the present invention, there is provided an image forming device which forms an image on a paper and to which a plurality of post processing devices each of which carries out a predetermined post processing to the paper on which the image is formed by the image forming device and ejects the paper are serially connected comprising a comparing unit to compare a stop time to an estimated ejection time when a request relating to a permission of an actuation stop of a predetermined post processing devices is made by the predetermined post processing device, the stop time being a time needed from when the predetermined post processing device starts a stopping operation after ejecting a last page before a change in the predetermined post processing device until the stopping operation is completed and the estimated ejection time being an estimated time until the paper is ejected after a post processing device which is an ejecting place is changed to a post processing device in an upstream side which is connected at the upstream side of the predetermined post processing device and after being changed back again to the predetermined post processing device and a stopping command unit to output a stopping command to the predetermined post processing device when the estimated ejection time is longer than the stop time as a result of a comparison by the comparing unit.

According to a fourth aspect of the present invention, there is provided an image forming device which forms an image on a paper and to which a plurality of post processing devices each of which carries out a predetermined post processing to the paper on which the image is formed by the image forming device and ejects the paper are serially connected comprising an image forming device determination unit to determine whether a post processing device which is an ejecting place is to be changed to a post processing device in an upstream side which is connected at the upstream side of a predetermined post processing device from the predetermined post processing device or not based on ejecting place information relating to a post processing device which ejects the paper, for each page, a storage unit to store a stop time which is a time needed from when each of the post processing devices starts a stopping operation after ejecting a last paper before a change in each of the post processing devices until the stopping operation is completed for each of the post processing devices, a comparing unit to compare an extracted stop time to an estimated ejection time when the image forming device determination unit determines that the post processing device which is the ejecting place is to be changed to the post processing device in the upstream side from the predetermined post processing device by extracting the stop time of the predetermined post processing device from the storage unit, the estimated ejection time being an estimated time until the paper is ejected after the post processing device which is the ejecting place is changed to the post processing device in the upstream side and after being changed back again to the predetermined post processing device, and a stopping command unit to output a stopping command to the predetermined post processing device when the estimated ejection time is longer than the stop time as a result of a comparison by the comparing unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, a structure of an image forming device according to the present invention will be described with reference to the drawings.

First Embodiment

Figure 1:
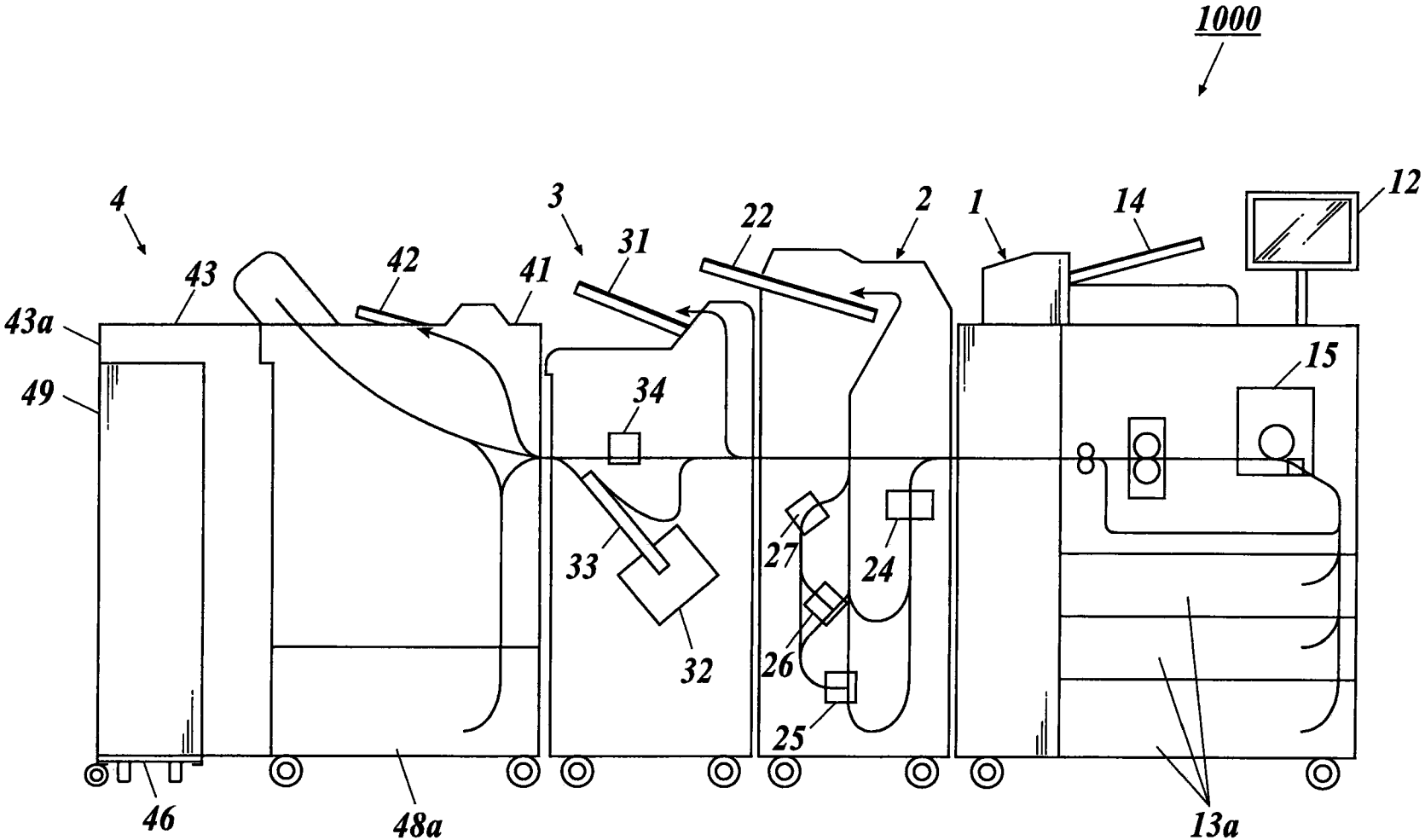
FIG. 1 is an overall view of an image forming system of an embodiment.

FIG. 1 is an overall view of an image forming system according to the first embodiment. The image forming system 1000 comprises an image forming device 1, a first post processing device 2, a second post processing device 3 and a third post processing device 4, and each of the above are connected in series with one another.

The image forming device 1 is a device which forms an image on a paper and outputted the paper, for example. As shown in FIG. 1, the image forming device 1 comprises an operation unit 12, a paper feeding tray 13*a*, an image forming unit 15, a conveyance unit 18, an image forming device control unit 100 and the like.

The operation unit 12 comprises LCD (Liquid Crystal Display), various types of operation keys, a touch panel integrally formed with the LCD and the like, for example. The operation unit 12 carries out a display of various types of operation buttons, condition of the device, operation state of each function and the like on the display screen according to the control signal inputted from the image forming device control unit 100, and also outputs operation signal according to pushing operation of an operation key and a pressing operation of the touch panel by a user to the image forming device control unit 100, for example.

Further, a user can set various types of post processing (for example, hole punch processing, folding processing, stapling processing, shift processing and case work processing) and size of paper to be ejected (for example, A4, B5 and the like) which are needed when forming an image on a paper and ejecting the paper at the image forming device 1 via the operation unit 12.

The paper feeding tray 13*a* holds papers for transferring (forming) images by their sizes, and when an image is formed on the paper by the image forming unit 15, the paper is to be conveyed to the first post processing device 2 by the conveyance unit 18.

The image forming unit 15 comprises a photoreceptor drum in which an electrostatic latent image is formed, a charging device for uniformly charging the photoreceptor drum, a laser unit for forming the electrostatic latent image by emitting the laser light which is turned on/off according to the image data to the uniformly charged photoreceptor surface, a developing device for visualizing the electrostatic latent image to a toner image, a transfer/separation device for separating the paper from the photoreceptor surface after transferring the toner image on the photoreceptor surface onto the paper which is conveyed, a cleaning device for removing residual toner on the photoreceptor surface after transferring, a fixing device for fixing the toner image on the paper by heating and pressing and the like, for example. The image forming unit 15 forms an image on a paper by electrographic method or the like, job by job, according to a control signal inputted from the image forming device control unit 100, for example. Further, the paper on which toner is fixed is conveyed to the first post processing device 2 by the conveyance unit 18.

The conveyance unit 18 comprises a conveyance roller, a conveyance belt, a motor for driving the conveyance roller and the conveyance belt and the like, for example. The conveyance unit 18 conveys a paper housed in the paper feeding tray 13*a* along the conveyance path and ejects the paper toward the first post processing device 2 according to the control signal inputted from the image forming device control unit 100, for example.

The image forming device control unit 100 integrally controls operations of each part which structures the image forming device 1. Detail of controlling structure of the image forming device 1 will be described in the after-mentioned (controlling structure of the image forming system) section.

The first post processing device 2 comprises a paper ejection tray 22, a hole punch processing unit 24, a folding processing unit 25, 26 and 27, a first post processing device control unit 200 and the like. The first post processing device 2 can carry out the hole punch processing and the folding processing as the post processing to the paper which is conveyed from the image forming device 1.

Here, as shown in FIG. 1, the paper which is ejected from the image forming device 1 can be ejected to the second post processing device 3 by the paper ejection roller and the like after the hole punch processing is carried out by the hole punch processing unit 24 or after the folding processing is carried by the paper passing through the folding processing units 25, 26 and 27. Alternatively, the paper can be ejected to the second post processing device 3 without passing through the hole punch processing unit 24 and the folding processing units 25, 26 and 27.

The paper ejection tray 22 can eject the paper to which the hole punch processing or the holding processing is carried out by the hole punch processing unit 24 or the folding processing units 25, 26 and 27.

The hole punch processing unit 24 comprises a punch, a dice, a drive mechanism for driving the punch and the dice and the like. The hole punch processing unit 24 carries out a processing of punching holes for filing to the paper.

The folding processing units 25, 26 and 27 carries out a predetermined folding processing such as folding in the middle to the paper.

Here, by using three of the folding processing units 25, 26 and 27, various types of folding processing such as double fold, threefold, gatefold and the like can be carried out.

The first post processing device control unit 200 integrally controls operation of each part constituting the first post processing device 2. Detail of controlling structure of the first post processing device 2 will be described in the after-mentioned (controlling structure of the image forming system) section.

The second post processing device 3 comprises a paper ejection tray 31, a stapling processing unit 32, a stacker 33, a shift processing unit 34 and a second post processing device control unit 300. The second post processing device 3 can carry out the stapling processing or the shift processing as a post processing to the paper which is conveyed from the first post processing device 2.

The paper ejection tray 31 can eject the paper to which the post processing is carried out at the first post processing device 2.

The stapling processing unit 32 carries out the stapling processing to the paper by hitting biding pins (staples) at two places at edge portion of the paper.

The stacker 33 accumulates a plurality of papers to which the stapling processing is to be carried out at the stapling processing unit 32.

The shift processing unit 34 carries out the shift processing for changing ejecting position of papers for every predetermined number of sheets of papers.

The second post processing device control unit 300 integrally controls operation of each part constituting the second post processing device 3. Detail of controlling structure of the second post processing device 3 will be described in the after-mentioned (controlling structure of the image forming system) section.

The third post processing device 4 comprises a bookbinding unit 41, a paper ejection tray 42, a booklet accumulating unit 43, a moving carrier 46, a cover paper housing unit 48*a*, a third post processing device control unit 400 and the like. The third post processing device 4 can carry out the case work processing as a post processing to the paper which is conveyed from the second post processing device 3.

The bookbinding unit 41 generates a booklet by applying glue to a bundle of papers and by wrapping the bundle of papers with the cover paper which is provided from the cover paper housing unit 48*a*.

The paper ejection tray 42 can eject paper to which the post processing is carried out in the second post processing device 3.

The booklet accumulating unit 43 comprises a case 43*a* and a door 49, and the booklet accumulating unit 43 accumulates the booklets which are generated at the bookbinding unit 41 and also moves the accumulated booklets to the moving carrier 46.

The case 43*a* is a case portion of the booklet accumulating unit 43.

The door 49 is provided at the left surface side of the case 43*a* so as to open and close freely, for example. Further, the door 49 can be opened when detaching the moving carrier 46.

The moving carrier 46 is detachably provided at the case 43*a* of the booklet accumulating unit 43. By moving the booklets to which the bookbinding is carried out and which are accumulated to the moving carrier 46, the booklets can be taken out from the third post processing device 4 to be carried.

The cover paper housing unit 48*a* houses the cover papers of a plurality of sizes, and provides a predetermined cover paper when bookbinding is to be carried out to the bundle of papers at the bookbinding unit 41.

The third post processing device control unit 400 integrally controls operation of each part constituting the third post processing device 4. Detail of controlling structure of the third post processing device 4 will be described in the after-mentioned (controlling structure of the image forming system) section.

(Controlling Structure of the Image Forming System)

Figure 2:
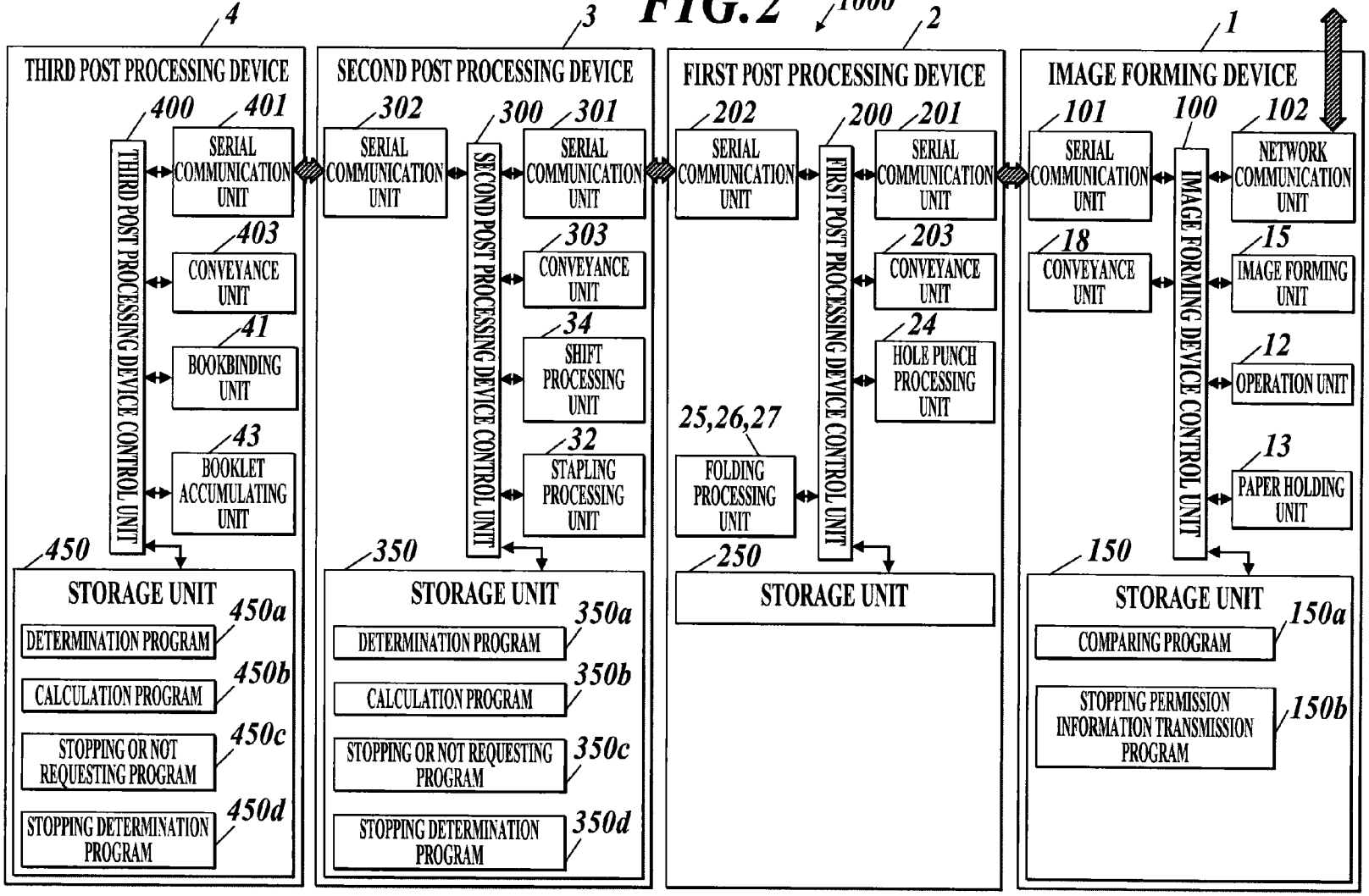
FIG. 2 is a block diagram of the image forming system of the embodiment.

Next, controlling structure of the image forming system 1000 will be described with reference to FIG. 2. FIG. 2 is a block diagram of the image forming system 1000 according to an embodiment of the present invention.

The image forming device 1 comprises the image forming device control unit 100, a serial communication unit 101 (ejecting place information informing unit, stopping permission information informing unit, stopping command unit), a network communication unit 102, the operation unit 12, the paper housing unit 13, the image forming unit 15 and the conveyance unit 18. Here, descriptions for the operation unit 12, the paper housing unit 13, the image forming unit 15 and the conveyance unit 18 are given above, therefore, the descriptions will be omitted.

The image forming device control unit 100 mainly comprises CPU and RAM, and controls the entire control of the image forming system such as the processing of the entire system including image reading, image forming and paper conveyance of the entire image forming device 1 and processing in the post processing device.

Further, when the image forming device control unit 100 receives the output setting such as various types of post processing which are set by a user via the operation unit 12 as the operation signal, the image forming device control unit 100 generates the ejecting place information which is structured with ID for identifying the post processing device which becomes the ejecting place, type of post processing which is needed for the relevant page, size of the ejecting paper and the like for each relevant page to which the image forming is to be carried out based on the operation signal, and the image forming device control unit 100 stores the generated information in the RAM along with an identifier (page ID) of the page which corresponds to the information.

The serial communication unit 101 carries out a function to transmit and receive information such as control information and the like with the first post processing device 2 which is connected at the downstream side by a serial communication. Here, because the serial communication unit is provided to all of the post processing devices which are included in the after-mentioned image forming system 1000, information transmitted by the serial communication unit 101 can be received by all of the post processing devices, and vice versa.

Further, the serial communication unit 101 transmits the discrimination ID of a page and the ejecting place information of the page which are stored in the RAM to each of the post processing devices page by page. Furthermore, the serial communication unit 101 transmits the stopping permission information to each of the post processing devices when executing the after-mentioned stopping permission information transmission program 150*b*.

The network communication unit 102 carries out a function to transmit and receive various types of information including printing data and ejecting place information between external devices such as a personal computer and the like via the LAN (local area network).

The storage unit 150 stores various types of setting information, a parameter which is needed to execute the processing by the program, data of processing results and the like other than various types of control programs to be executed by the first post processing device control unit 200. The storage unit 150 comprises a comparing program 150*a* (comparing unit), a stopping permission information transmission program 150*b* (stopping permission information informing unit, stopping command unit) and the like, for example.

The comparing program 150*a* is a program for making the image forming device control unit 100 execute the processing to compare the stop time of the device targeted for determination to the estimated ejection time when determination for stopping or not is requested by the second post processing device 3 and the third post processing device 4 (device targeted for determination). The estimated ejection time is a time needed until the paper is ejected after the device targeted for determination changes the ejecting place of the paper to the post processing device which is connected at upstream side and after the ejection place is changed to the device targeted for determination again.

Particularly, when the determination for stopping or not of own device (device targeted for determination) is requested to the image forming device 1 by the second post processing device control unit 300 executing the after-mentioned stopping or not request program 350*c* or by the third post processing device control unit 400 carrying out the after-mentioned stopping or not request program 450*c*, the image forming device control unit 100 executes the comparing program 150*a* and compares the stop time which is transmitted from the after-mentioned calculation program 350*b* or the calculation program 450*b* to the estimated ejection time. When the estimated ejection time is more than or equal to the stop time, it is determined that the device targeted for determination is to be stopped. When the estimated ejection time is less than the stop time, it is determined that the device targeted for determination is not to be stopped.

Here, an estimated ejection time is a value (for example, 1×4 seconds) where an estimated time (for example, 1 second) from when a paper is conveyed to the device targeted for determination from the image forming device 1 until the device targeted for determination ejects the paper is multiplied by a difference of a page (for example page 13) after the relevant page (for example, page 9) to which the device targeted form determination is assigned as the ejecting place and the relevant page.

The stopping permission information transmission program 150*b* is a program to make the image forming device control unit 100 execute a processing of transmitting the stopping permission information to the device targeted for determination via the serial communication unit 101 when it is determined that the estimated ejection time is more than the stop time by the execution of the comparing program 150*a*.

Here, the stopping permission information is information constituted with ID for discriminating the device targeted for determination, a flag which permits stopping of the device targeted for determination, time capable of stopping and the like.

Further, the stopping permission information transmission program 150*b* may output a predetermined signal related to a command (stopping command) for stopping the device targeted for determination to the device targeted for determination.

The first post processing device 2 comprises the first post processing device control unit 200, the serial communication units 201, 202, the conveyance unit 203, the hole punch processing unit 24, the storage unit 250 and the folding processing units 25, 26 and 27. Here, descriptions for the hole punch processing unit 24 and the folding processing units 25, 26 and 27 are given above, therefore, the descriptions will be omitted.

The first post processing device control unit 200 mainly comprises CPU and RAM, and controls the control of post processing (hope punch processing, folding processing) of the hole punch processing unit 24 and the folding processing units 25, 26 and 27 and the like.

The serial communication units 201, 202 carry out a function to transmit and receive information such as control information and the like with the image forming device 1 which is connected at the upstream side and the second post processing device 3 which is connected at the downstream side by the serial communication.

Further, the serial communication units 201, 202 receive a discrimination ID of a page and ejecting place information of the page from the image forming device 1 for each page and transmit the obtained ID and ejection place information to the second post processing device 3.

The conveyance unit 203 controls a conveyance path for a paper conveyed from the image forming device 1 (for example, a path for conveying the paper to the paper ejection tray 22 following the hole punch processing unit 24, a path for conveying the paper to the second post processing device 3 without carrying out post processing, and the like).

The storage unit 250 stores various types of setting information, a parameter which is needed for the program to execute processing, data of processing results, ID and executing place information of the page which are transmitted by the image forming device 1 and the like.

The second post processing device 3 comprises the second post processing device control unit 300, the serial communication units 310, 302 (transmission unit), the conveyance unit 303, the storage unit 350, the stapling processing unit 32 and the shift processing unit 34.

Here, descriptions of the stapling processing unit 32 and the shift processing unit 34 are as given above, therefore, the descriptions will be omitted.

The second post processing device control unit 300 mainly comprises CPU and RAM, and controls the control of post processing (stapling processing and shift processing) of the stapling processing unit 32 and the shift processing unit 34 and the like.

The serial communication units 301, 302 carries out a function to transmit and receive information such as control information and the like with the first post processing device control unit 2 which is connected at the upstream side and the third post processing unit 4 which is connected at the downstream side by the serial communication.

Further, the serial communication units 301, 302 receive a discrimination ID of a page and ejecting place information of the page from the first post processing device 2 page by page, and transmits the received ID and ejecting place information to the third post processing device 4.

The conveyance unit 303 controls the conveyance path of a paper which is conveyed from the first post processing device 2 (for example, a path for conveying the paper to the paper ejection tray 31 following the shift processing unit 34, a path for conveying the paper to the third post processing device 4 without carrying out post processing and the like).

The storage unit 350 stores various types of information, a parameter needed for the program to execute the processing, data of processing results, ID and ejecting place information of the page which are transmitted from the image forming device 1 and the like other than various types of programs to be executed by the second post processing device control unit 300. The storage unit 350 comprises a determination program 350*a* (determination unit), a calculation program 350*b* (calculation unit, transmission unit), a stopping or not request program 350*c* (permission request unit), a stopping determination program 350*d* (actuation determination unit) and the like, for example.

The determination program 350*a* is a program to make the second post processing device control unit 300 execute a process of determining whether the post processing device which is the ejecting place is to be changed to a post processing device which is connected at the upstream side from the second post processing device 3 which is the own device (device targeted for determination) for each page based on the ejecting place information stored in the storage unit 350.

That is, when the second post processing device control unit 300 executes the determination program 350*a*, ejecting place information up to the relevant page and page ID which are stored in the storage unit 350 are obtained and whether the ejecting place of the page previous to the relevant page is own device or a post processing device which is connected in downstream side than the own device and whether the ejecting place of the relevant page is a post processing device which is connected in upstream side than the own device (for example, the first post processing device) or not (that is, a possibility of the own device can be stopped at page ejection after the relevant page by the ejecting place being changed to a device in upstream side) can be determined.

The calculation program 350*b* is a program to make the second post processing device control unit 300 execute a process to calculate the stop time which is a time needed from when the own device (device targeted for determination) starts the stopping operation (standby state or power cutoff state or the like) until the stopping operation is completed.

That is, the stop time of the own device is not decided uniquely and the stop time sequentially changes according to content of the post processing which was carried out until the own device starts the stopping operation, size of the paper to which the post processing is executed and the like. Therefore, by the second post processing device control unit 300 executing the calculation program 350*b*, an accurate stop time can be calculated every time by taking the ejecting place information and the like into consideration when calculating the stop time, for example.

Further, the above calculated stop time is to be transmitted to the image forming device 1 via the serial communication unit 301.

The stopping or not request program 350*c* is a program to make the second post processing device control unit 300 execute a processing of requesting the determination for stopping or not of the own device (device targeted for determination) to the image forming device 1.

That is, by the second post processing device control unit 300 executing the stopping or not request program 350*c*, the determination for stopping or not can be requested to the image forming device 1 by a predetermined signal and the like via the serial communication unit 301, for example.

The stopping determination program 350*d* is a program to make the second post processing device control unit 300 execute a process for starting the stopping operation of the own device when the stopping permission information is transmitted from the image forming device 1 and for continuing the operation without executing the stopping operation of the own device when the stopping permission information is not transmitted.

The third post processing device 4 comprises the third post processing device control unit 400, the serial communication unit 401 (transmission unit), the conveyance unit 403, the storage unit 405, the bookbinding unit 41 and the booklet accumulating unit 43.

Here, descriptions of the bookbinding unit 41 and the booklet accumulating unit 43 are as given above, therefore, the descriptions will be omitted.

The third post processing device control unit 400 mainly comprises CPU and RAM, and controls the control of post processing such as the case work processing and the like of the third post processing device and the like.

The serial communication unit 401 carries out a function to transmit and receive information such as the control information and the like with the second post processing device control unit 3 which is connected at the upstream side.

Further, the serial communication unit 401 receives the discrimination ID of a page and ejecting place information of the page from the second post processing device 3 for each page.

The conveyance unit 403 controls a conveyance path (for example, a path for conveying a paper to the paper ejection tray 41 and the like) of the paper which is conveyed from the second post processing device 3.

The storage unit 450 stores various types of setting information, a parameter which is needed for a program to execute processing, data of processing results, ID and ejecting place information of the relevant page which are transmitted by the image forming device 1 and the like other than various types of control programs to be executed by the third post processing device control unit 400. The storage unit 450 comprises the determination program 450*a* (determination unit), the calculation program 450*b* (calculation unit, transmission unit), the stopping or not request program 450*c* (permission request unit), the stopping determination program 450*d* (actuation determination unit) and the like, for example. Here, contents of processing for the determination program 450*a*, the calculation program 450*b*, the stopping or not request program 450*c* and the stopping determination program 450*d* are respectively same as the determination program 350*a*, the calculation program 350*b*, the stopping or not request program 350*c* and the stopping determination program 350*d*, therefore, the descriptions will be omitted.

(Regarding Determination Processing by the Post Processing Device)

Figure 3:
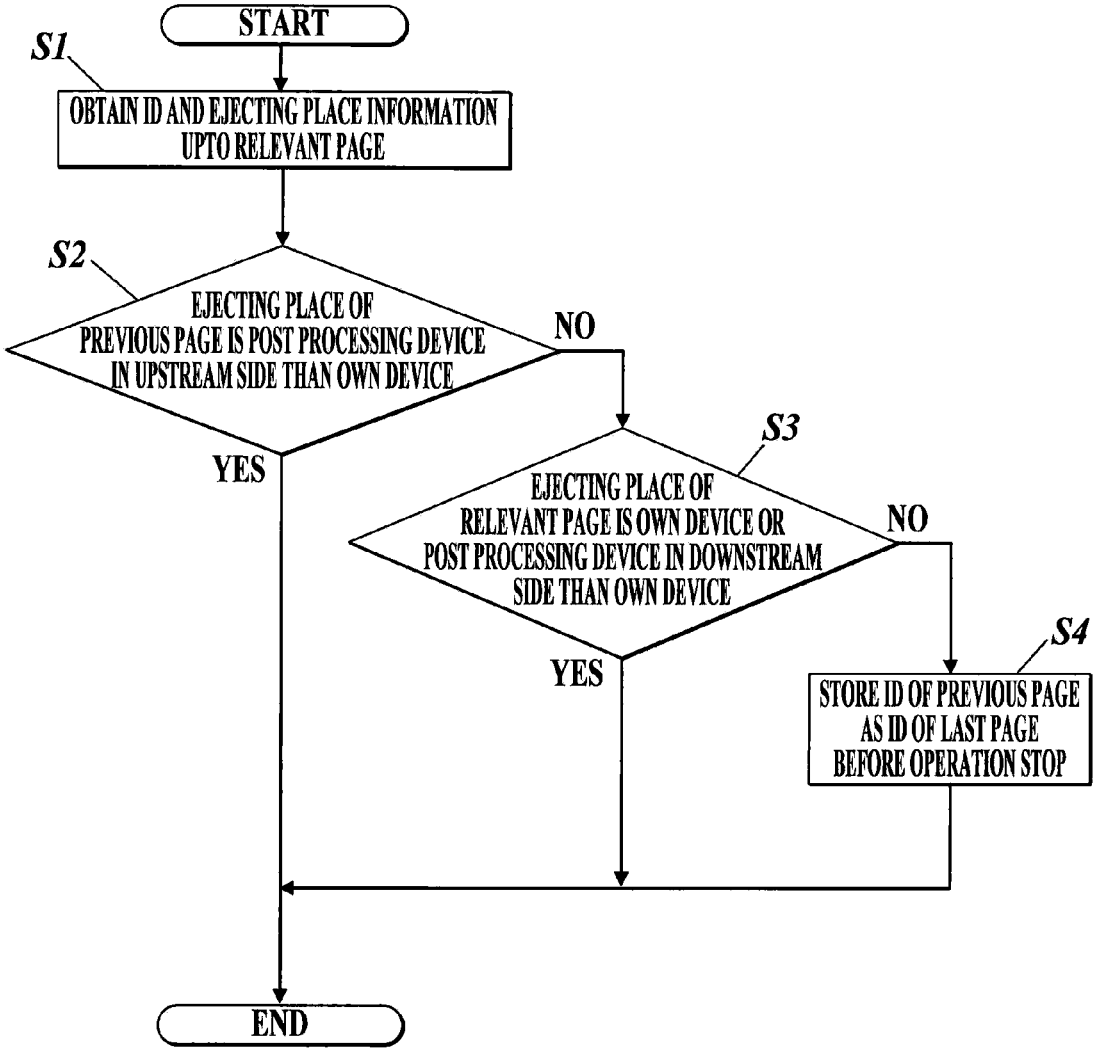
FIG. 3 is a flowchart showing a determination processing of the embodiment.

The second post processing device 3 and the third post processing device 4 carry out a determination processing as shown in the flowchart of FIG. 3 by executing the determination program 350*a* and the determination program 450*a*. Here, the own device (device targeted for determination) indicates the second post processing device 3 in the determination program 350*a* and indicates the third post processing device 4 in the determination program 450*a*.

First, the second post processing device control unit 300 or the third post processing device control unit 400 (hereinafter, they will be called the control unit in the description of the processing) obtains ID and ejecting place information of pages up to the relevant page which are stored in the storage units 350 and 450 (step S1).

Next, the control unit determines whether the ejecting place of previous page is the post processing device which is connected at upstream side of the own device or not by the ejecting place information and the page ID obtained in step S1 (step S2).

Then, the control unit finishes the process when it is determined that the ejecting place of previous page is the post processing device which is connected at the upstream side of the own device in step S2 (step S2; Yes).

On the other hand, when it is not determined that the ejecting place of previous page is the post processing device which is connected in the upstream side of the own device in step S2 (step S2; No), the control unit determines whether the ejecting place of the relevant page is the own device or the post processing device which is connected in downstream side than the own device (step S3). When the ejecting place of the relevant page is the own device or the post processing device which is connected at downstream side than the own device, the process is finished (step S3, Yes).

On the other hand, when it is determined that the ejecting place of the relevant page is not the post processing device which is connected in downstream side than the own device (step S3; No), the control unit stores the ID of previous page in the storage units 350, 450 as an ID of the last page before operation stop of the own device (step S4).

(Regarding Calculation Processing and Request for Stopping or not by the Post Processing Device)

Figure 4:
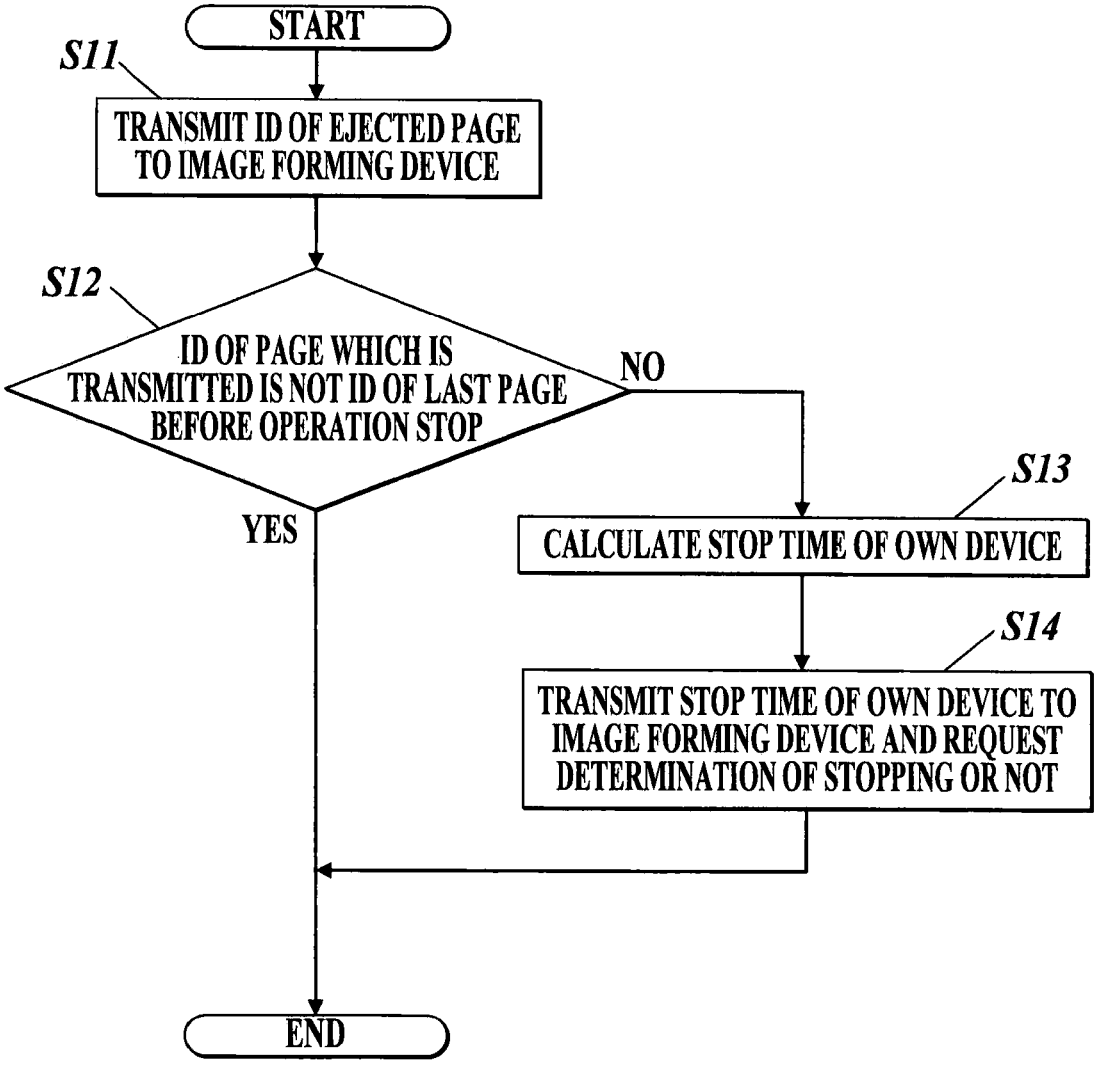
FIG. 4 is a flowchart showing a calculation processing and a request for stopping or not of the embodiment.

By the execution of the calculation program 350*b* and calculation program 450*b* and by the execution of the stopping or not request program 350*c* and the stopping or not request program 450*c*, the calculation processing and the request for stopping or not are carried out as shown in the flowchart of FIG. 4.

First, the second post processing device control unit 300 or the third post processing device control unit 400 (hereinafter, they are called the control unit in the description of the process) carries out the post processing, and transmits the ID of a page which is ejected to the image forming device 1 via the serial communication units 301, 401 for each page (step S11).

Next, the control unit determines whether the ID of the page which is transmitted in step S11 is not the ID of the last page before operation stop which is stored in step S4 of FIG. 3 (step S12).

Then, when the control unit determines that the ID of the page which is transmitted in step S11 is not the ID of the last page before operation stop in step S12 (step S12; Yes), there are still pages to be ejected in the own device and the process is finished without the stop time of the own device being calculated because the stopping operation cannot be started.

On the other hand, when the control unit determines that the ID of the page which is transmitted in step S11 is the ID of the last page before operation stop in step S12 (step S12; No), the stop time of the own device is calculated (step S13), and the determination for stopping or not is requested by transmitting a predetermined signal along with transmitting the calculated stop time to the image forming device 1 via the serial communication units 301, 401 (step S14).

(Regarding Comparing Processing and Stopping Permission Information Transmission Processing by the Image Forming Device)

Figure 5:
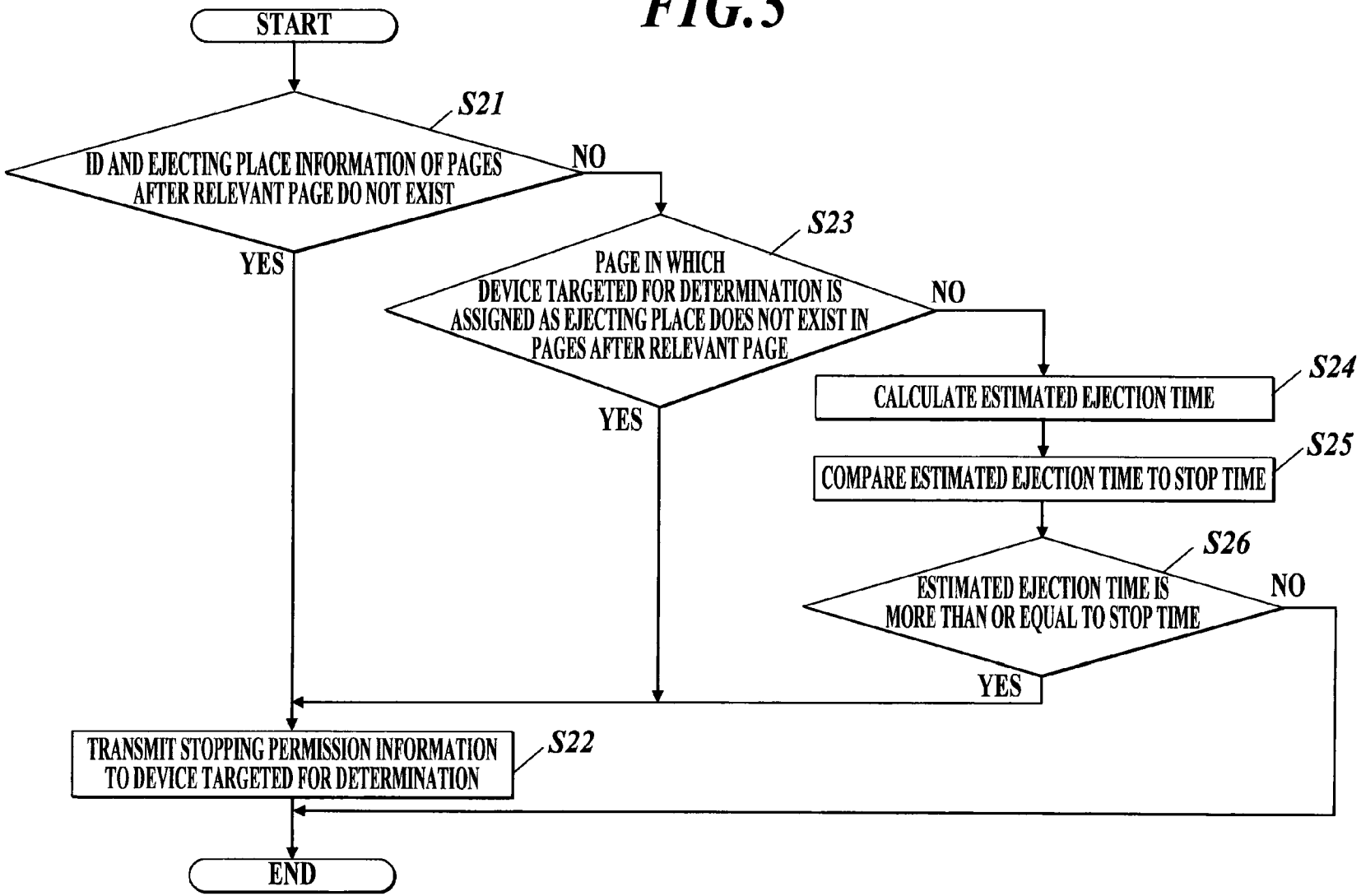
FIG. 5 is a flowchart showing a comparison processing and a stopping permission information transmission processing of the embodiment.

By the execution of the comparing program 150*a* and the stopping permission information transmission program 150*b*, the comparing processing and the stopping permission information transmission processing as shown in the flowchart of FIG. 5 are carried out.

First, the image forming device control unit 100 determines whether ID and ejecting place information (that is, reserved job and the like) of pages after the relevant page do not exist by the RAM (step S21).

Then, when the image forming device control unit 100 determines that ID and ejecting place information of pages after the relevant page do not exist in step S21 (step S21; Yes), the image forming device control unit 100 transmits the stopping permission information to the device targeted for determination (that is, the own device shown in FIGS. 3 and 4) (step S22).

On the other hand, when the image forming device control unit 100 determines that ID and ejecting place information of pages after the relevant page exist in step S21 (step S21; No), the image forming device control unit 100 determines whether a page to which the device targeted for determination is assigned as the ejecting place does not exist in the pages after the relevant page (step S23).

Then, when the image forming device control unit 100 determines that a page in which the device targeted for determination is assigned as the ejecting place does not exist in step S23 (step S23; Yes), the image forming device control unit 100 carries out the process of step S22.

Thereafter, when the image forming device control unit 100 determines that a page to which the device targeted for determination is assigned as the ejecting place exists in step S23 (step S23; No), the image forming device control unit 100 calculates an estimated ejection time (step S24) and carries out a comparison of the estimated ejection time and the stop time (step S25).

Next, when the image forming device control unit 100 determines that the estimated ejection time is more than or equal to the stop time (step S26; Yes), the image forming device control unit 100 carries out step S22.

On the other hand, when the image forming device control unit 100 determines that the estimated ejection time is less than the stop time (step S26; No), the image forming device control unit 100 finishes the process.

(Regarding Stopping Determination Processing by the Post Processing Device)

Figure 6:
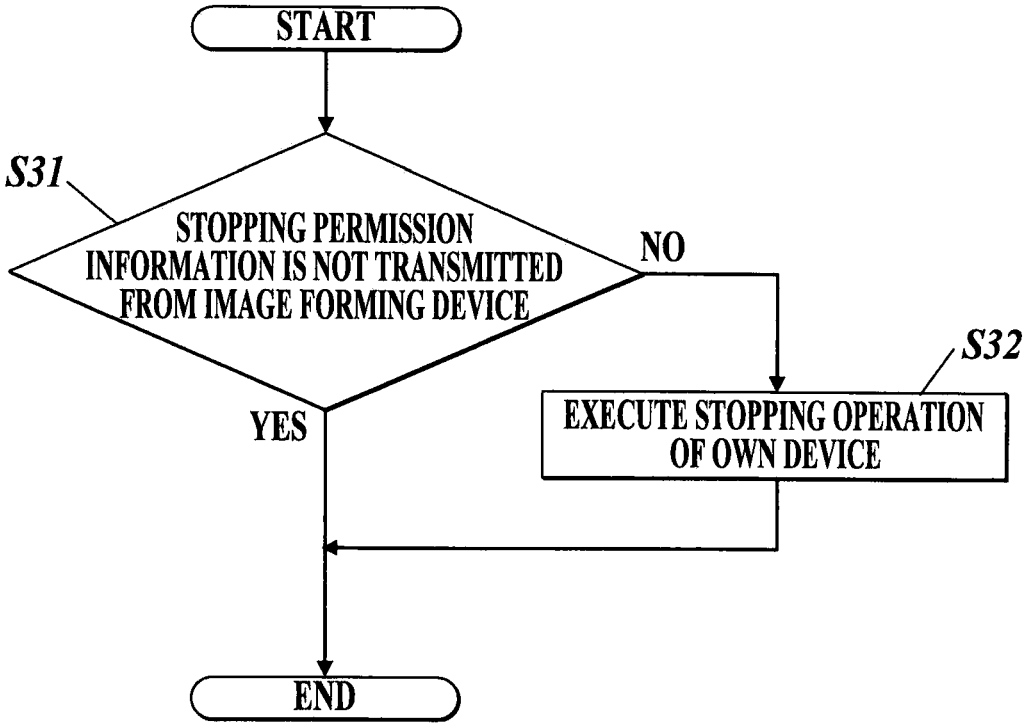
FIG. 6 is a flowchart showing a stopping determination processing of the embodiment.

By the execution of the stopping determination program 350*d* and the stopping determination program 450*d*, the stopping determination processing as shown in the flowchart of FIG. 6 is carried out.

First, the control unit determines whether the stopping permission information is transmitted from the image forming device 1 or not (step S31).

Then, when the control unit determines that the stopping permission information is not transmitted from the image forming device 1 (step S31; Yes), the control unit continues the operation without executing the stopping operation of the own device.

On the other hand, when the control unit determines that the stopping permission information is transmitted from the image forming device 1 (step S31; No), the control unit executes the stopping operation of the own device (step S32).

(Regarding Stopping Processing of the Post Processing Device by the Image Forming System)

Figure 7:
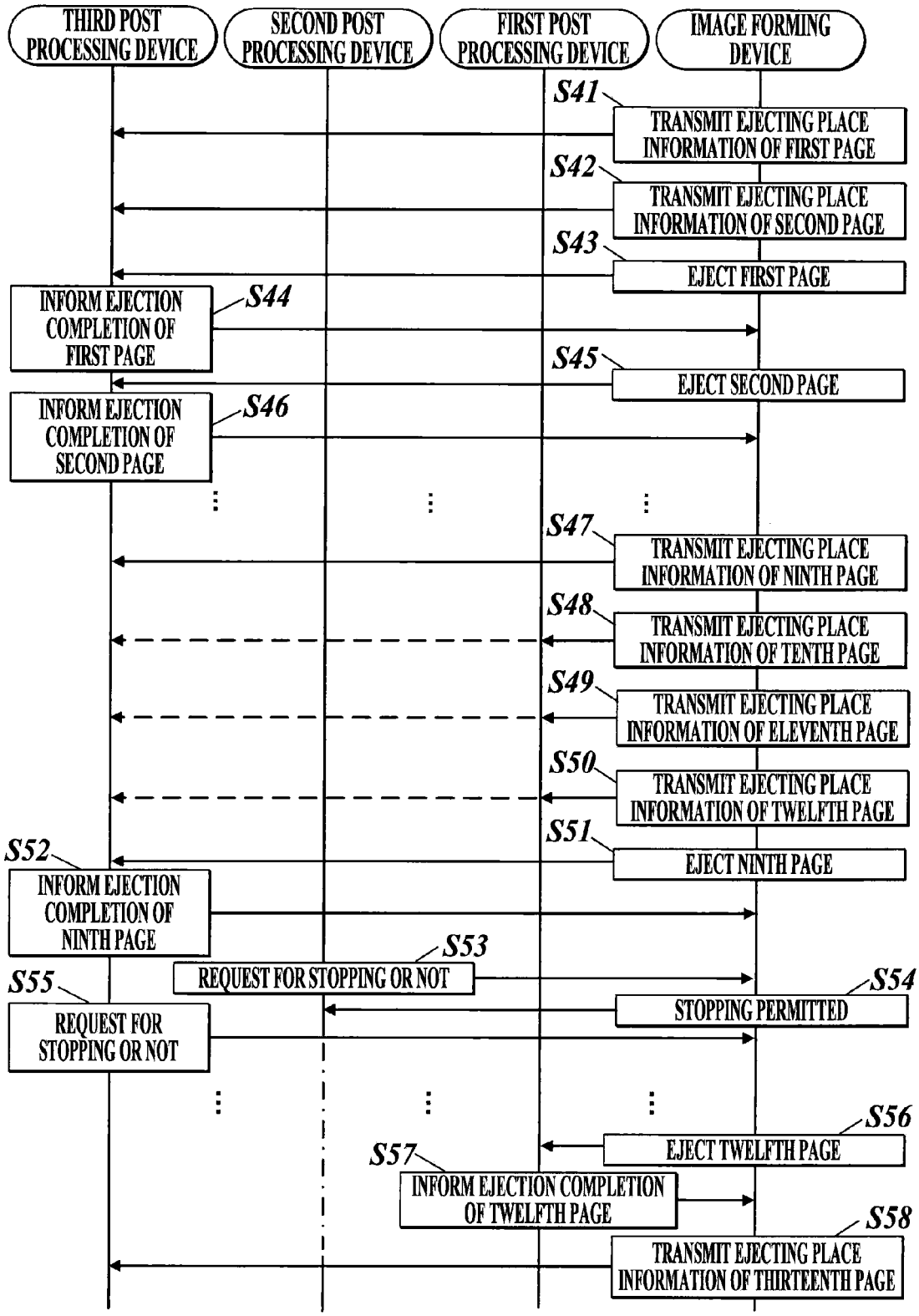
FIG. 7 is a flowchart showing a stopping processing of a post processing device of the embodiment.

Hereinafter, stopping processing of the post processing device by the image forming system 100 will be described with reference to the flowchart shown in FIG. 7.

First, a description is given for a case where the ejecting place of first and second pages to which the image forming is carried out by the image forming device 1 is the third post processing unit 4. The image forming device 1 transmits discrimination ID of first and second pages and ejecting place information of first and second pages to each of the post processing devices (the first post processing device 2 to the third post processing device 4) page by page via the serial communication unit 101 (step S41, S42).

Next, when the image forming device 1 ejects the first page to the third post processing device 4 (step S43), the third post processing device 4 informs the image forming device 1 of the completion of ejection of the first page (step S44). Further, as for the second page, a similar process as steps S43 and S44 is carried out (step S45, S46).

Thereafter, the above described process of steps S41 to S44 continues up to eighth page.

Next, it is assumed that the third post processing device 4 is to be the ejecting place of ninth page to which the image forming device 1 carries out an image forming, that the first post processing device 2 is to be the ejecting place of tenth to twelfth pages and that the third post processing device 4 is to be the ejecting place of thirteenth page.

The image forming device 1 transmits the discrimination ID of ninth to twelfth pages and ejecting place information of ninth to twelfth pages to each of the post processing devices (the first post processing device 2 to the third post processing device 4) page by page via the serial communication unit 101 (steps S47 to S50). At this time, the second post processing device 3 (the second post processing device control unit 300) and the third post processing device 4 (the third post processing device control unit 400) respectively executes the determination program 350*a* and 450*a*, and determine that the own device can be stopped after tenth page by setting ninth page to the last page before operation stop. Here, ejecting place information of thirteenth page is not yet transmitted to each of the post processing devices at this time.

Next, when the image forming device 1 ejects ninth page to the third post processing device 4 (step S51), the third post processing device 4 informs the image forming device 1 that the ejection of ninth page is completed (step S52).

Next, the second post processing device 3 executes the calculation program 350*b* and the stopping or not request program 350*c* to calculate the stop time of the own device (for example, 0.5 seconds) because the ninth page which is the last page before operation stop is ejected, and transmits the stop time to the image forming device 1 to request the determination for stopping to not to the image forming device 1 (step S53).

Next, the image forming device 1 executes the comparing program 150*a*, and recognizes that the ejecting place of thirteenth page is the third post processing device 4 to determine that the estimated ejection time (for example, 4 seconds) for the paper to be ejected to the second post processing device 3 is more than or equal to the stop time and executes the stopping permission information transmission program 150*b*, thereafter, the image forming device 1 transmits the stopping permission information to the second post processing device 3 to permit stopping (step S54).

On the other hand, similarly to step S53, the third post processing device 4 also executes the calculation program 450*b* and the stopping or not request program 450*c*, and requests the determination for stopping or not to the image forming device 1 by transmitting the stop time (for example, 10 seconds) of the own device (step S55).

In such case, the image forming device 1 executes the comparing program 150*a* to determine that the estimated ejection time (for example, 4 seconds) for the paper to be ejected to the third post processing device 4 is less than the stop time, and the image forming device 1 does not transmit the stopping permission information to the third post processing device 4 (that is, the third post processing device 4 is not made to stop).

Then, the image forming device 1 ejects twelfth page to the first post processing device 2 (step S56) and the first post processing device 2 informs the image forming device 1 that the ejection of twelfth page is completed (step S57). Thereafter, when the discrimination ID of thirteenth page and the ejecting place information of thirteenth page are transmitted to each of the post processing devices from the image forming device 1, the second post processing device 3 restarts the actuation (step S58).

The above described process will be repeated after thirteenth page.

[Modification 1]

The stop time in the above embodiment does not necessary have to be sequentially calculated by executing the calculation program 350*b* and the calculation program 450*b*. For example, estimated value of time needed until stopping is completed from when the stopping is started for each of the post processing devices may be calculated in advance, and the estimated values may be stored in the storage unit 150 of the image forming device 1 as the stop time.

Figure 8A:
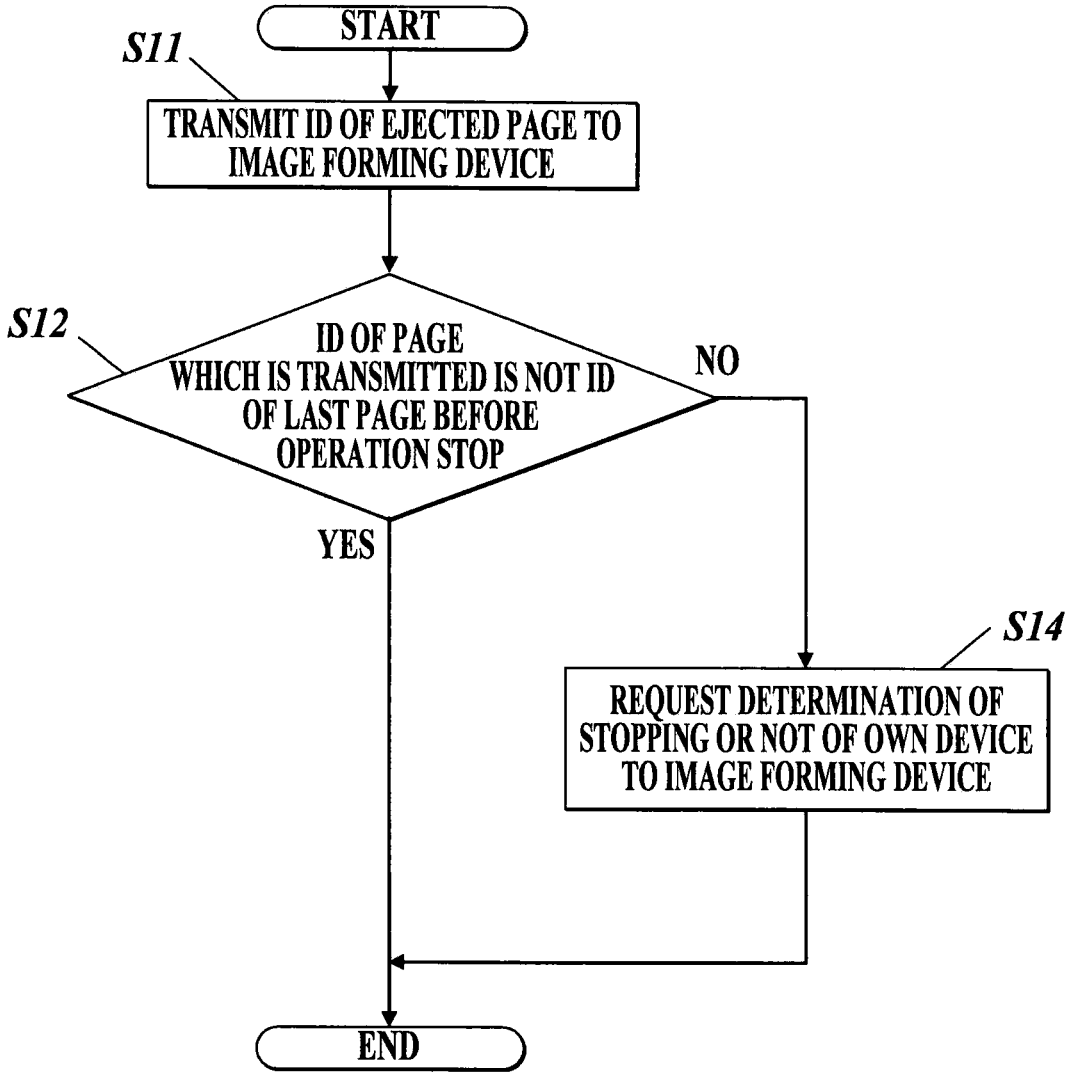
FIG. 8A is a flowchart showing a request for stopping or not of another embodiment.
Figure 8B:
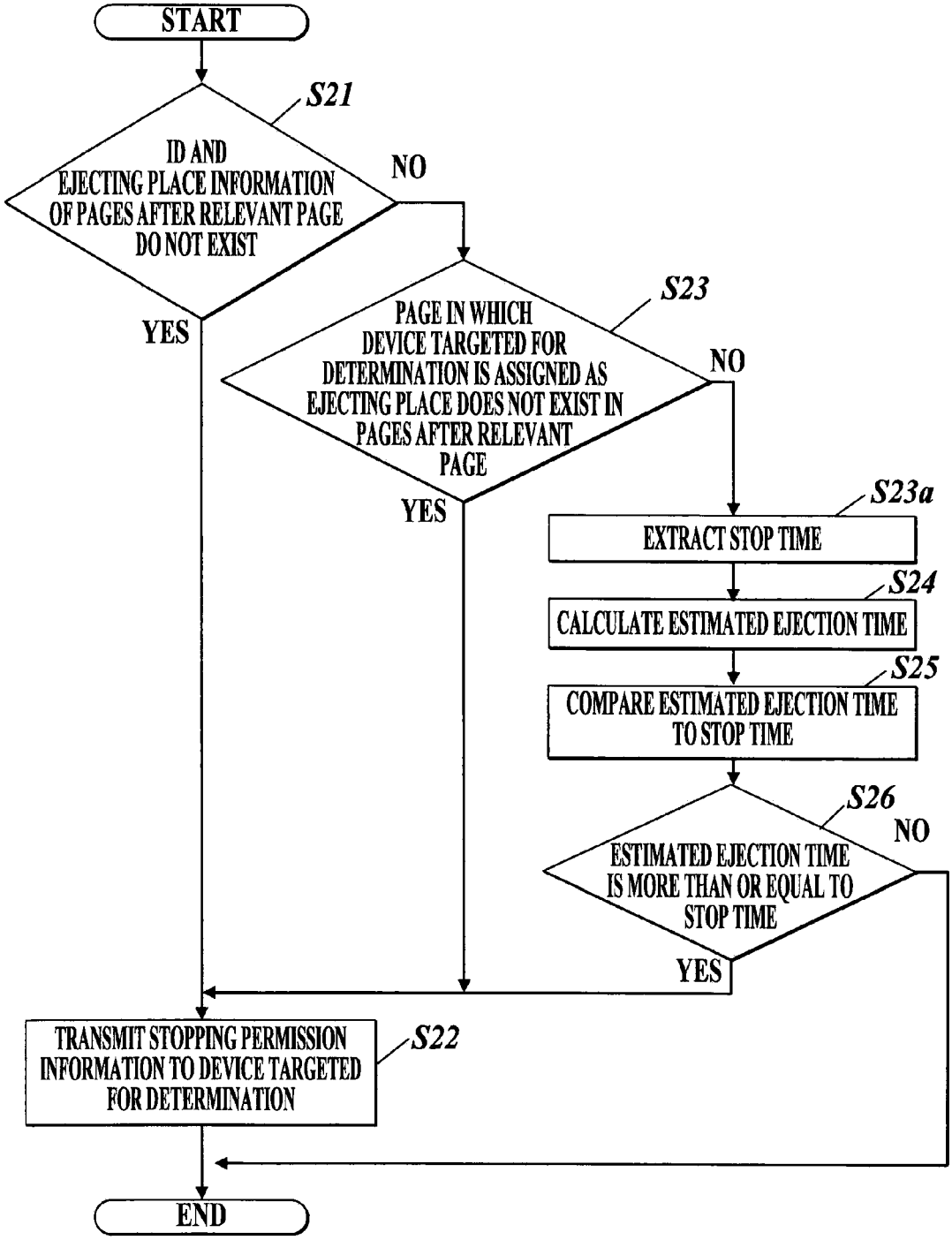
FIG. 8B is a flowchart showing a comparison processing and a stopping permission information transmission processing of the another embodiment.

In such case, the calculation of stop time by the post processing device in FIG. 4 (step S13) is not carried out as shown in the flowchart of FIG. 8A and FIG. 8B differs from FIG. 8A in that the stop time of the device targeted for determination (that is, the post processing device in FIG. 8A) which is stored in the storage unit 150 is extracted (step S23*a*) when the image forming device control unit 100 executes the comparing program 150*a* before calculating the estimated ejection time (step S24) as shown in the flowchart of FIG. 8B.

In such way, according to the image forming system 1000 of present invention, when the post processing devices (the second post processing device 3 and the third post processing device 4) determine that the post processing device which is the ejecting place is changed to the post processing device in upstream side which is connected at the upstream side of the own device from the own device by executing the determination programs 350*a*, 450*a* based on the ejecting place information transmitted by the serial communication unit 101 of the image forming device 1, the post processing devices request a permission for operation stop of the own device to the image forming device 1 by executing the stopping or not request programs 350*c*, 450*c*. Then, when the image forming device 1 receives the above request, the image forming device 1 compares the stop time to the estimated ejection time by executing the comparing program 150*a* and informs the stopping permission information to the post processing device by executing the stopping permission information transmission program 150*b* when the estimated ejection time is longer than the stop time. Further, the post processing devices stop the operation when the stopping permission information is informed and the post processing devices continue the operation when the stopping permission information is not informed by executing the stopping determination programs 350*d*, 450*d*.

That is, according to the image forming system 1000, power saving and restriction of noise can be realized by the post processing devices stopping the operation when the estimated ejection time being greater than the stop time. Further, drop down in productivity of the image forming system 1 such as a case where the image forming device needs to be in a waiting state until the operation of the post processing device stops because the operation of the post processing device is continuing, even when it is requested to eject the paper to the post processing device during the time when the post processing cannot be executed because the post processing device is in the middle of stopping the operation, that is, when the stopping time is more than the estimated ejection time, can be prevented.

Therefore, the present invention is an invention of an image forming system in which power saving and restriction of noise can be realized without the productivity of the entire system being reduced.

Moreover, in the image forming system 1000 of the present invention, stop time of the own device can be calculated by executing the calculation programs 350*b*, 450*b* and the stop time can be transmitted to the image forming device 1 when it is determined that a post processing device which is the ejecting place has been changed to a post processing device in upstream side which is connected at the upstream side of the own device from the own device by executing the determination program 350*a*, 450*a*.

That is, stop time of the own device is not decided uniquely and the stop time sequentially changes according to content of the post processing which has been carried out until the own device starts the stopping operation, size of the paper to which the post processing is to be executed and the like. Therefore, by executing the calculation programs 350*b*, 450*b*, an accurate stop time can be calculated every time by taking the ejecting place information and the like into consideration when calculating the stop time. Thus, the ejection time and the stop time can be compared more accurately by using the above calculated stop time by executing the comparing program 150*a*.

Further, in the image forming system 1000 of the present invention, estimated value of time which is needed until stopping of the post processing device is completed from the stopping is started for each of the post processing devices may be calculated in advance and the estimated values may be stored in the storage unit 150 of the image forming device 1 as stop time instead of stop time which is sequentially calculated by the execution of calculation program 350*b* and the calculation program 450*b*.

That is, by extracting the stop time which is stored in the storage unit 150 by the execution of the comparing program 150*a*, the calculation programs 350*b*, 450*b* are need not to be executed and this enables the processing load of the post processing device to be reduced.

Second Embodiment

Figure 9:
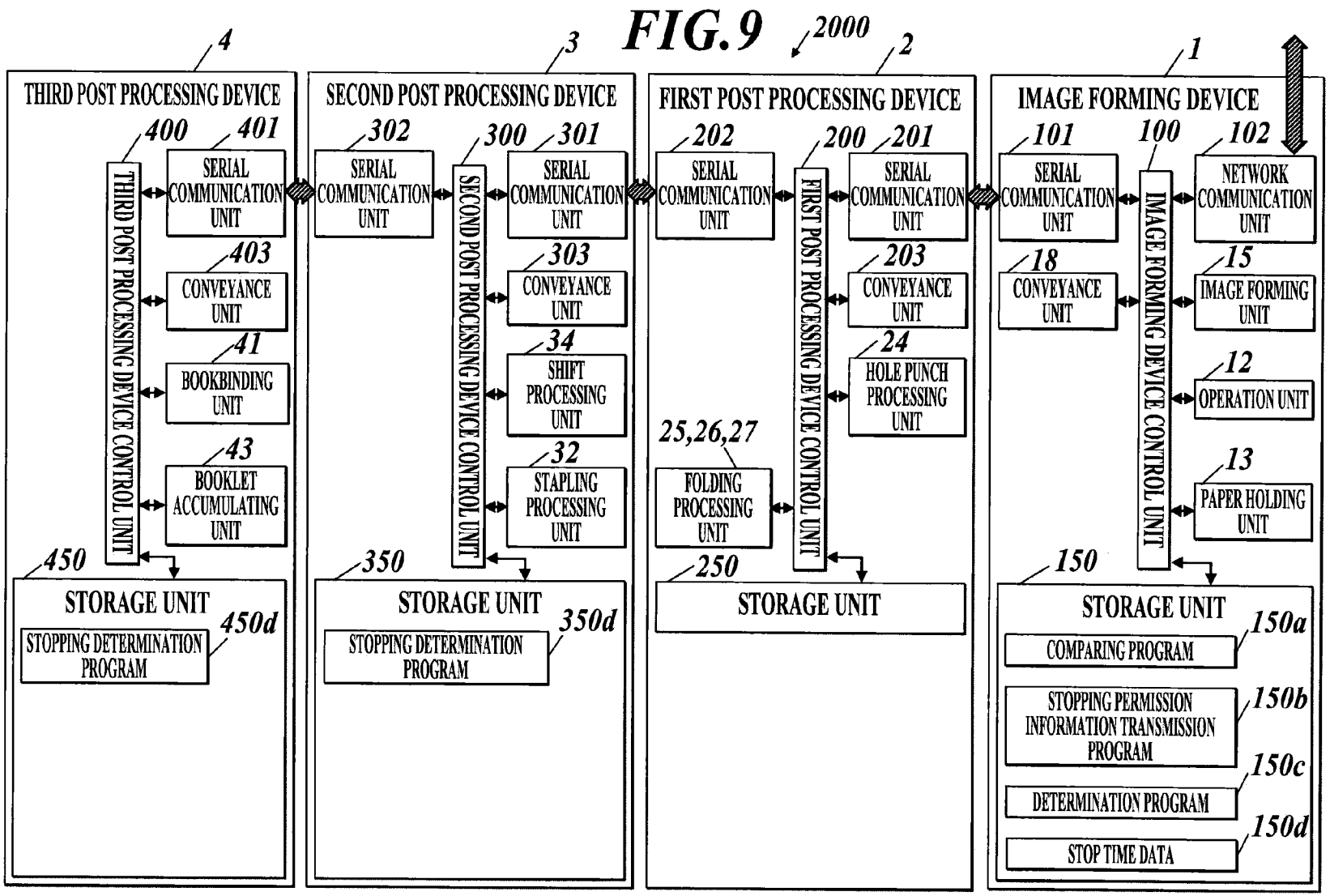
FIG. 9 is a block diagram of an image forming system of the another embodiment.

A block diagram of an image forming system 2000 according to the second embodiment of the present invention is shown in FIG. 9. The image forming system 2000 of the second embodiment differs from the image forming system 1000 of the first embodiment shown in FIG. 2 in that the determination program 150*c* (image forming device determination unit) and the stop time data 150*d* are stored in the storage unit 150 (storage unit) of the image forming device 1 instead of the determination program, the calculation program and the stopping or not request program which are stored in the storage unit 350 of the second post processing device 3 and in the storage unit 450 of the third post processing device 4.

Hereinafter, same reference numerals are used for the structures which are same as the image forming system 1000 and the descriptions will be omitted, and the differences will be described.

The determination program 150*c* is a program for determining whether the post processing device which is the ejecting place is to be changed to a post processing device which is connected at the upstream side from the post processing device or not based on the ejecting place information.

That is, when the image forming device control unit 100 executes the determination program 150*c*, the ejecting place information of pages up to the relevant page and ID of the pages which are stored in the RAM are obtained to determine whether the ejecting place (device targeted for determination) of the previous page of the relevant page and the ejecting place of the relevant page are different or not.

The stop time data 150*d* is data in which stop time which is a time needed from starting of the stopping operation until the stopping operation is completed for a post processing device (device targeted for determination) which is to be compared by the comparing program 150*a* is stored for each of the post processing devices.

(Regarding Determination Processing by the Image Forming Device)

Figure 10:
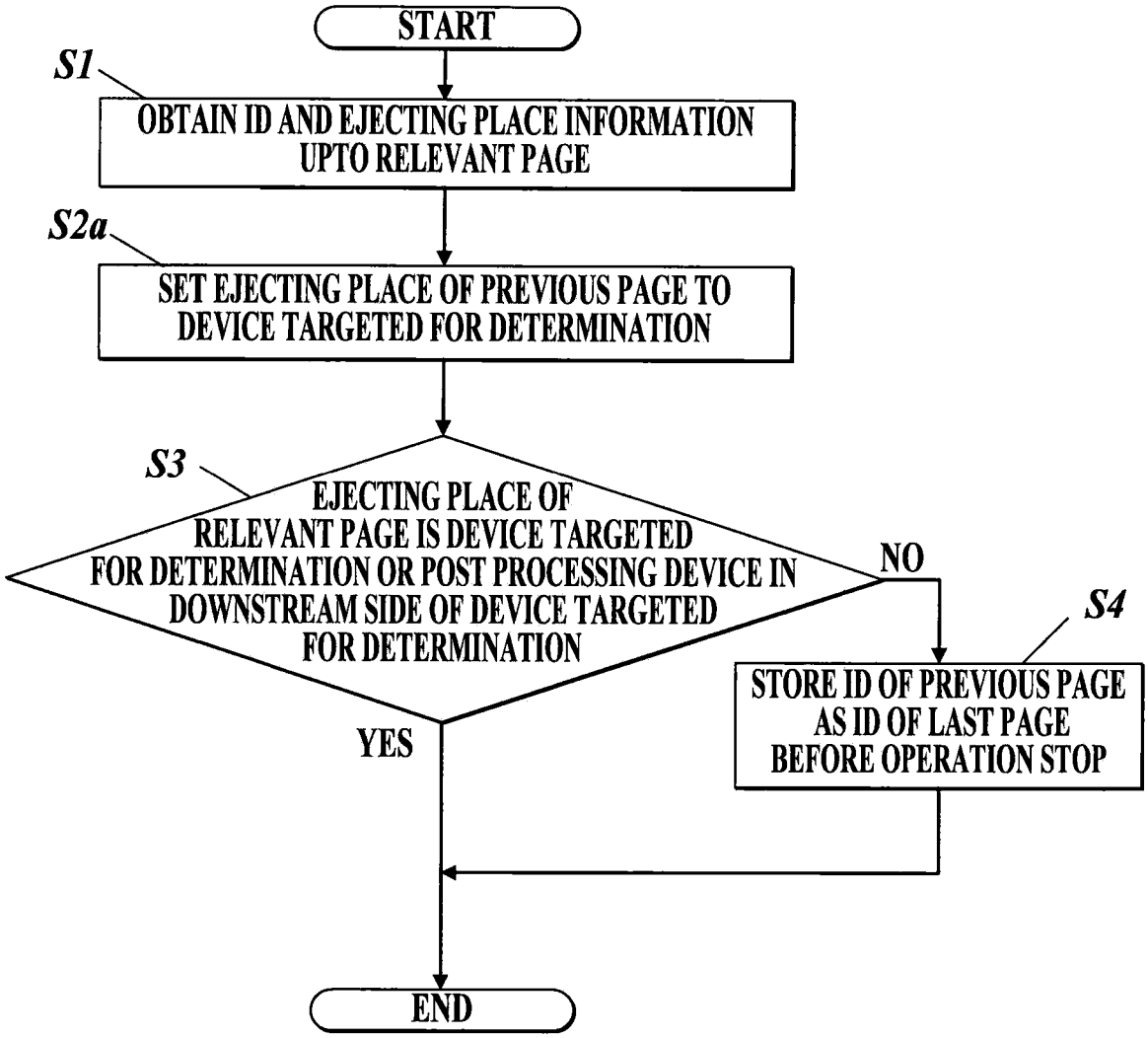
FIG. 10 is a flowchart showing a determination processing of the another embodiment.

By the execution of the determination program 150*c*, determination processing shown in a flowchart of FIG. 10 is carried out. Here, a difference between the flowchart of FIG. 10 and the flowchart according to the determination processing by the post processing device in FIG. 3 is that the image forming device control unit 100 sets the ejecting place of a page previous to the relevant page to the device targeted for determination based on the ejecting place information which is obtained in step S1 (step S2*a*) in FIG. 10 instead of determining the ejecting place of previous page in step S2 in FIG. 3.

(Regarding Comparing Processing and Stopping Permission Information Transmission Processing by the Image Forming Device)

Figure 11:
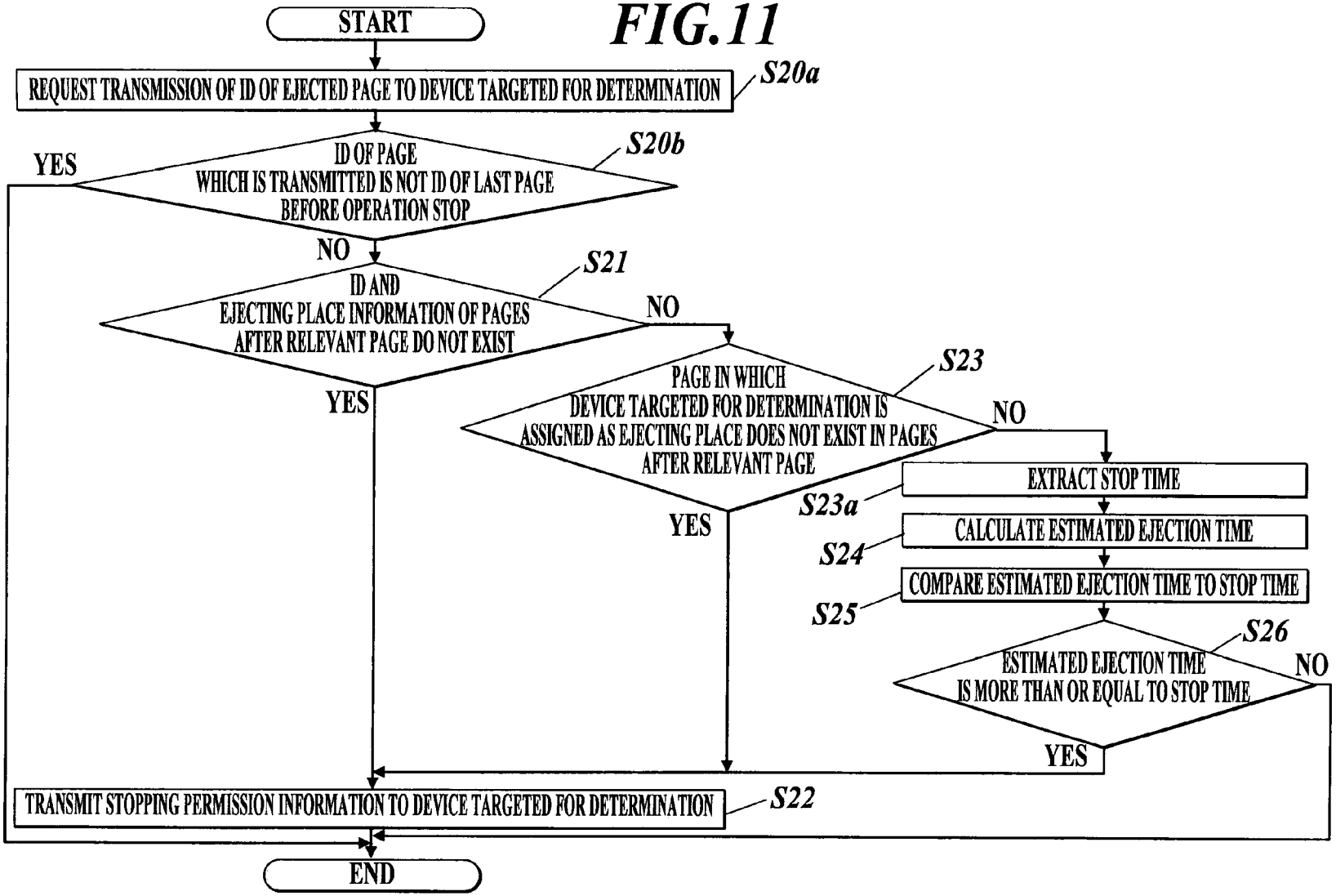
FIG. 11 is a flowchart showing a comparison processing and a stopping permission information transmission processing of the another embodiment.

By the execution of the comparing program 150*a*, the comparing processing and the stopping permission information transmission processing as shown in the flowchart of FIG. 11 are carried out. Here, the flowchart of FIG. 11 differs from the flowchart according to the comparing processing and the stopping permission information transmission processing of FIG. 5 in two aspects.

One of the different aspects is that the processes of step S11 and step S12 in FIG. 4 (ejection confirmation processing of last page in the device targeted for determination) are carried out in the image forming device 1 side before the determination processing of step S21 in FIG. 5.

Particularly, the image forming device control unit 100 carries out a request to the device targeted for determination so as to transmit the ID of pages to which the post processing is carried out by the device targeted for determination and which are ejected to the image forming device 1 page by page (step S20*a*).

Further, the image forming device control unit 100 determines whether the ID of pages which are transmitted in step S20*a* are not the ID of last page before operation stop of the device targeted for determination (step S20*b*). When the image forming device control unit 100 determines that the ID is not the ID of last page (step S20*b*; Yes), the image forming device control unit 100 finishes the process. When the image forming device control unit 100 determines that the ID is the ID of last page (step S20*b*; No), the image forming device control unit 100 carries out the process of step S21 and thereafter.

Another of the different aspects is that the stop time which is stored in the storage unit 150 is extracted (step S23*a*) before carrying out the calculation of estimated ejection time of step S24 of FIG. 5 because calculation of stop time by the device targeted for determination shown in step S13 of FIG. 4 is not carried out in the modification example.

First, the image forming device control unit 100 determines whether ID and ejecting place information of pages after the relevant page (that is reserved job and the like) do not exist by the RAM (step S21).

Thereafter, when the image forming device control unit 100 determines that the ID and the ejecting place information of pages after the relevant page do not exist in step S21 (step S21; Yes), the image forming device control unit 100 transmits stopping permission information to the device targeted for determination (step S22).

On the other hand, when the image forming device control unit 100 determines that the ID and the ejecting place information of pages after the relevant page exist in step S21 (step S21; No), the image forming device control unit 100 determines whether a page to which the device targeted for determination is assigned as the ejecting place does not exist in pages after the relevant page (step S23).

Further, when the image forming device control unit 100 determines that a page to which the device targeted for determination is assigned as the ejecting place does not exist in step S23 (step S23; Yes), the image forming device control unit 100 carries out the process of step S22.

Then, when the image forming device control unit 100 determines that a page to which the device targeted for determination is assigned as the ejecting place exists in step S23 (step S23; No), the image forming device control unit 100 calculates an estimated ejection time (step S24) and carries out a comparison between the estimated ejection time and the stop time (step S25).

Next, when the image forming device control unit 100 determines that the estimated ejection time is more than or equal to the stop time (step S26; Yes), the image forming device control unit 100 carries out the process of step S22.

On the other hand, when the image forming device control unit 100 determines that the estimated ejection time is less than the stop time (step S26; No), the image forming device control unit 100 finishes the process.

In such way, according to the image forming system 2000 of the present invention, the determination program 150*c* (image forming device determination unit) is stored in the storage unit 150 (storage unit) of the image forming device 1 instead of the determination program and the stopping or not request program stored in the storage unit 350 of the second post processing device 3 and in the storage unit 450 of the third post processing device 4 in the image forming system 1000.

That is, according to the image forming system 2000, the determination of whether the post processing device which is the ejecting place is to be changed to a post processing device in upstream side which is connected at the upstream side of the predetermined post processing device from the predetermined post processing device or not which was carried out at the post processing device side in the image forming system 10000 is carried out at the image forming device side. Therefore, processing load at the post processing device side can be reduced, and also, the post processing device can be made to stop promptly because the above determination can be carried out before the ejecting place information is transmitted to the post processing device.

Here, scope of the present invention is not limited to the above described embodiments, and various modifications and change in design may be carried out within the scope of the present invention.

For example, when the image forming device 1 ejects a paper, the post processing device in upstream side of the first post processing device 2 may be made to be the image forming device 1, and a function similar to the second post processing device 3 and the third post processing device 4 may be given to the image forming device 1 by providing the determination program, the calculation program, the stopping or not request program and the stopping determination program to the image forming device 1.

Moreover, devices which can carry out the hole punch processing, the folding processing, the stapling processing and the shift processing are exemplified for the post processing devices (the first post processing device 2 to the third post processing device 4) in the above embodiments. However, a large capacity stacker which can accumulate a large amount of paper, for example, may be used in addition to than the above exemplified devices.

According to the above embodiments, when the estimated ejection time is more than the stop time, power saving and restriction of noise can be realized by the post processing devices stopping their operation. Further, drop down in productivity of the image forming system 1 such as a case where the image forming device needs to be in a waiting state until the operation of the post processing device stops because the stopping operation of the post processing device is continuing, even when it is requested to eject the paper to the post processing device during the time when the post processing operation cannot be executed because the post processing device is in the middle of stopping the operation, that is, when the stopping time is more than the estimated ejection time, can be prevented.

Therefore, the embodiments can be said to be the image forming system and the image forming device which can realize the power saving and restriction of noise without reducing the productivity of the entire system.

According to a first aspect of the preferred embodiment of the present invention, there is provided an image forming system comprising an image forming device to form an image on a paper and a plurality of post processing devices which are serially connected to the image forming device and each of which carries out a predetermined post processing to the paper on which the image is formed by the image forming device and ejects the paper, and the image forming device comprises an ejecting place information informing unit to inform ejecting place information relating to a post processing device which becomes an ejecting place of the paper page by page to each of the post processing devices, a comparing unit to compare a stop time to an estimated ejection time when a request is made by a permission request unit of a post processing device, the stop time being a time needed from when the post processing device starts a stopping operation after ejecting a last paper before a change in the post processing device which is requested until when the stopping operation is completed and the estimated ejection time being an estimated time until the paper is ejected after the post processing device which is the ejecting place is changed to the post processing device in an upstream side and after being changed back again to the post processing device and a stopping permission information informing unit to inform stopping permission information to the post processing device which made the request when the estimated ejection time is longer than the stop time as a result of a comparison by the comparing unit, and the post processing devices comprise a determination unit to determine whether a post processing device which is the ejecting place is to be changed to the post processing device in the upstream side which is connected at the upstream side of an own device or not for each page based on the ejecting place information informed by the ejecting place information informing unit, a permission request unit to request a permission to stop an actuation of the own device to the image forming device when the determination unit determines that the post processing device which is the ejecting place is to be changed to the post processing device in the upstream side from the own device and an actuation determination unit to execute the stopping operation when the stopping permission information is informed by the stopping permission information informing unit and not to execute the stopping operation when the stopping permission information is not informed.

Preferably, the post processing devices comprise a calculation unit to calculate the stop time when the determination unit determines that the post processing device which is the ejecting place is to be changed to the post processing device in the upstream side from the own device and a transmission unit to transmit the stop time which is calculated by the calculation unit to the image forming device.

Preferably, the image forming device comprises a storage unit to store the stop time which is a time needed from when each of the post processing devices starts the stopping operation after ejecting the last paper before the change in each of the post processing devices until when the stop operation is completed, for each of the post processing devices, and the comparing unit extracts the stop time from the storage unit.

According to a second aspect of the preferred embodiment of the present invention, there is provided an image forming system comprising an image forming device to form an image on a paper and a plurality of post processing devices which are serially connected to the image forming device and each of which carries out a predetermined post processing to the paper on which the image is formed by the image forming device and ejects the paper, and the image forming device comprises an image forming device determination unit to determine whether a post processing device which is an ejecting place is to be changed to a post processing device in an upstream side which is connected at the upstream side of a predetermined post processing device from the predetermined post processing device or not for each page based on ejecting place information relating to the post processing device to which the paper is to be ejected, a comparing unit to compare a stop time to an estimated ejection time when the image forming device determination unit determines that the post processing device which is the ejecting place is to be changed to the post processing device in the upstream side from the predetermined post processing device, the stop time being a time needed from when the predetermined post processing device starts a stopping operation after ejecting a last paper before a change in the predetermined post processing device until the stopping operation is completed and the estimated ejection time being an estimated time until the paper is ejected after the post processing device which is the ejecting place is changed to the post processing device in the upstream side and after being changed back again to the predetermined post processing device and a stopping permission information informing unit to inform stopping permission information to the predetermined post processing device when the estimated ejection time is longer than the stop time as a result of a comparison by the comparing unit, and the predetermined post processing device comprises an actuation determination unit to execute the stopping operation when the stopping permission information is informed by the stopping permission information informing unit and not to execute the stopping operation when the stopping permission information is not informed.

Preferably, the image forming device comprises a storage unit to store the stop time which is a time needed from when each of the post processing devices starts the stopping operation after ejecting the last paper before the change in each of the post processing devices until when the stop operation is completed, for each of the post processing devices and the comparing unit extracts the stop time from the storage unit.

According to a third aspect of the preferred embodiment of the present invention, there is provided an image forming device which forms an image on a paper and to which a plurality of post processing devices each of which carries out a predetermined post processing to the paper on which the image is formed by the image forming device and ejects the paper are serially connected comprising a comparing unit to compare a stop time to an estimated ejection time when a request relating to a permission of an actuation stop of a predetermined post processing devices is made by the predetermined post processing device, the stop time being a time needed from when the predetermined post processing device starts a stopping operation after ejecting a last page before a change in the predetermined post processing device until the stopping operation is completed and the estimated ejection time being an estimated time until the paper is ejected after a post processing device which is an ejecting place is changed to an post processing device in an upstream side which is connected at the upstream side of the predetermined post processing device and after being changed back again to the predetermined post processing device and a stopping command unit to output a stopping command to the predetermined post processing device when the estimated ejection time is longer than the stop time as a result of a comparison by the comparing unit.

According to a fourth aspect of the preferred embodiment of the present invention, there is provided an image forming device which forms an image on a paper and to which a plurality of post processing devices each of which carries out a predetermined post processing to the paper on which the image is formed by the image forming device and ejects the paper are serially connected comprising an image forming device determination unit to determine whether a post processing device which is an ejecting place is to be changed to a post processing device in an upstream side which is connected at the upstream side of a predetermined post processing device from the predetermined post processing device or not based on ejecting place information relating to a post processing device which ejects the paper, for each page, a storage unit to store a stop time which is a time needed from when each of the post processing devices starts a stopping operation after ejecting a last paper before a change in each of the post processing devices until the stopping operation is completed for each of the post processing devices, a comparing unit to compare an extracted stop time to an estimated ejection time when the image forming device determination unit determines that the post processing device which is the ejecting place is to be changed to the post processing device in the upstream side from the predetermined post processing device by extracting the stop time of the predetermined post processing device from the storage unit, the estimated ejection time being an estimated time until the paper is ejected after the post processing device which is the ejecting place is changed to the post processing device in the upstream side and after being changed back again to the predetermined post processing device and a stopping command unit to output a stopping command to the predetermined post processing device when the estimated ejection time is longer than the stop time as a result of a comparison by the comparing unit.

The present U.S. patent application claims the priority of Japanese Patent Application No. 2008-286411 filed on Nov. 7, 2008 according to the Paris Convention, and the above Japanese Patent Applications are the basis for correcting mistranslation of the present U.S. patent application.

What is claimed is:

1. An image forming system, comprising:

an image forming device to form an image on a paper, and a plurality of post processing devices which are serially connected to the image forming device and each of which carries out a predetermined post processing to the paper on which the image is formed by the image forming device and ejects the paper when designated as an ejecting place, wherein each one of the plurality of post processing devices comprises:

a determination unit configured to determine whether the ejecting place is to be changed to another post processing device located in the upstream side of the post processing device based on ejecting place information from the image forming device, a permission request unit configured to request a permission to stop the one of the plurality of post processing devices from the image forming device when the determination unit determines that the ejecting place is to be changed to the another post processing device located in the upstream side of the post processing device, and an actuation determination unit configured to execute a stopping operation of the post processing device when stopping permission information from the image forming device is received and not to execute the stopping operation when the stopping permission information is not received, and wherein the image forming device comprises:

an ejecting place information informing unit to inform the ejecting place information relating to which of the plurality of post processing devices is designated as the ejecting place of the paper, page by page, to each of the plurality of post processing devices, a comparing unit to compare a stop time to an estimated ejection time when a request is made by the permission request unit of one of the plurality of post processing devices, the stop time being calculated by a calculation unit and being a time needed to complete a stopping operation of the post processing device which made the request after ejecting a last paper before a change of the ejecting place to the another post processing device, the estimated ejection time being calculated by the comparing unit and being an estimated time between when the ejecting place is changed to the another post processing device located in the upstream side and when the paper is ejected in the post processing device which made the request after being changed back as the ejecting place, and a stopping permission information informing unit to inform the stopping permission information to the post processing device which made the request when the estimated ejection time is longer than the stop time as a result of a comparison by the comparing unit.

2. An image forming system, comprising: an image forming device to form an image on a paper, and a plurality of post processing devices which are serially connected to the image forming device and each of which carries out a predetermined post processing to the paper on which the image is formed by the image forming device and ejects the paper when designated as an ejecting place, wherein the image forming device comprises an image forming device determination unit to determine whether the ejecting place is to be changed from a predetermined post processing device to another post processing device located in the upstream side of the predetermined post processing device for each page based on ejecting place information relating to which of the plurality of post processing devices is to be designated as the ejecting place, a comparing unit to compare a stop time to an estimated ejection time when the image forming device determination unit determines that the ejecting place is to be changed from the predetermined post processing device to the another post processing device located in the upstream side of the predetermined post processing device, the stop time being calculated by a calculation unit and being a time needed to complete a stopping operation of the predetermined post processing device after ejecting a last paper before a change of the ejecting place to the another post processing device, the estimated ejection time being calculated by the comparing unit and being an estimated time between when the ejecting place is changed to the another post processing device located in the upstream side and when the paper is ejected in the predetermined processing device after being changed back as the ejecting place, and a stopping permission information informing unit to inform stopping permission information to the predetermined post processing device when the estimated ejection time is longer than the stop time as a result of a comparison by the comparing unit, and wherein the predetermined post processing device comprises an actuation determination unit to execute the stopping operation when the stopping permission information is informed by the stopping permission information informing unit and not to execute the stopping operation when the stopping permission information is not informed.

3. The image forming system of claim 1, wherein the post processing devices comprise a transmission unit to transmit the stop time which is calculated by the calculation unit to the image forming device.

4. The image forming system of claim 1, wherein the image forming device comprises a storage unit to store the stop time for each of the post processing devices, and the comparing unit extracts the stop time from the storage unit.

5. The image forming system of claim 2, wherein the image forming device comprises a storage unit to store the stop time for each of the post processing devices, and the comparing unit extracts the stop time from the storage unit.

6. An image forming device which forms an image on a paper and connects serially to a plurality of post processing devices, each of which carries out a predetermined post processing to the paper, comprising:

a comparing unit to compare a stop time to an estimated ejection time when a predetermined post processing device makes a request relating to a permission to stop the predetermined post processing device, the stop time being calculated by a calculation unit and being a time needed to complete a stopping operation of the predetermined post processing device after ejecting a last page before a change of the ejecting place to another, the estimated ejection time being calculated by the comparing unit and being an estimated time between when the ejecting place is changed to the another post processing device located in the upstream side and when the paper is ejected in the predetermined post processing device after being changed back as the ejecting place, and a stopping command unit to output a stopping command to the predetermined post processing device when the estimated ejection time is longer than the stop time as a result of a comparison by the comparing unit.

7. An image forming device which forms an image on a paper and connects serially to a plurality of post processing devices, each of which carries out a predetermined post processing to the paper and ejects the paper when designated as an ejecting place, comprising:

an image forming device determination unit to determine whether the ejecting place is to be changed from a predetermined post processing device to another post processing device located in the upstream side of the predetermined post processing device based on ejecting place information relating to which of the plurality of post processing devices is designated as the ejecting place, for each page, a storage unit to store a stop time for each of the post processing devices, the stop time being a time needed to complete a stopping operation of each of the post processing devices after ejecting a last paper before a change of the ejecting place to the another post processing device, a comparing unit to compare an extracted stop time to an estimated ejection time when the image forming device determination unit determines that the ejecting place is to be changed from the predetermined post processing device to the another post processing device located in the upstream side of the predetermined post processing device by extracting the stop time of the predetermined post processing device from the storage unit, the estimated ejection time being calculated by the comparing unit and being an estimated time between when the ejecting place is changed to the another post processing device located in the upstream side and when the paper is ejected in the predetermined processing device after being changed back as the ejecting place, and a stopping command unit to output a stopping command to the predetermined post processing device when the estimated ejection time is longer than the stop time as a result of a comparison by the comparing unit.

* * * * *